US006723179B2

(12) United States Patent
Yagi et al.

(10) Patent No.: US 6,723,179 B2
(45) Date of Patent: Apr. 20, 2004

(54) SOFT MAGNETISM ALLOY POWDER, TREATING METHOD THEREOF, SOFT MAGNETISM ALLOY FORMED BODY, AND PRODUCTION METHOD THEREOF

(75) Inventors: Wataru Yagi, Nagoya (JP); Kota Maruyama, Toyoake (JP); Yoshiharu Iyoda, Okazaki (JP); Aiko Nakashima, Toyota (JP); Toshihisa Terazawa, Anjo (JP); Naoki Kamiya, Chiryu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 151 days.

(21) Appl. No.: 09/977,333

(22) Filed: Oct. 16, 2001

(65) Prior Publication Data

US 2002/0046782 A1 Apr. 25, 2002

(30) Foreign Application Priority Data

Oct. 16, 2000 (JP) ..... 2000-315282

(51) Int. Cl.[7] ..... H01F 1/18

(52) U.S. Cl. ..... 148/300; 148/306; 148/307; 75/255; 75/428; 75/403

(58) Field of Search ..... 148/300, 306, 148/307, 304, 403; 75/255; 428/403

(56) References Cited

U.S. PATENT DOCUMENTS

| | | | | | |
|---|---|---|---|---|---|
| 4,197,146 | A | * | 4/1980 | Frischmann | 148/304 |
| 4,385,944 | A | * | 5/1983 | Hasegawa | 148/104 |
| 5,252,148 | A | * | 10/1993 | Shigeta et al. | 148/307 |
| 5,277,977 | A | * | 1/1994 | Tokuoka et al. | 428/402 |
| 5,407,458 | A | * | 4/1995 | Konig et al. | 75/255 |
| 5,549,973 | A | * | 8/1996 | Majetich et al. | 428/403 |
| 5,597,531 | A | * | 1/1997 | Liberti et al. | 422/57 |
| 6,376,063 | B1 | * | 4/2002 | Rasmussen et al. | 428/328 |
| 6,607,807 | B2 | * | 8/2003 | Zinbo et al. | 428/141 |

* cited by examiner

*Primary Examiner*—John P. Sheehan
(74) *Attorney, Agent, or Firm*—Oblon, Spivak, McClelland, Maier & Neustadt, P.C.

(57) ABSTRACT

A soft magnetism metal powder having a majority of particles, each of which, when cross-sectioned, has no greater than ten crystal particles on average, may be coated on an outer surface of each of the particles with a resistive material having a higher resistivity than the underlying parent phase. The soft magnetism metal powder may be prepared by heating a soft magnetism metal powder to a high temperature in a high temperature atmosphere, thereby reducing the number of crystal particles in each of the soft magnetism metal powder particles. A soft magnetism metal formed body may be prepared by pressing the soft magnetism metal particles at a sufficient temperature and pressure.

18 Claims, 5 Drawing Sheets

X 200 x 200 x 200 x 400 x 400 x 200 x 200

SOFT MAGNETISM ALLOY POWDER, TREATING METHOD THEREOF, SOFT MAGNETISM ALLOY FORMED BODY, AND PRODUCTION METHOD THEREOF

The present application is based on and claims priority under 35 U.S.C. § 119 with respect to Japanese Patent Application No.2000-315282 filed on Oct. 16, 2000 (12th year of Heisei), the entire contents of which are incorporated herein by reference.

FIELD OF THE INVENTION

The present invention is generally directed to a soft magnetism metal powder, a method of treating soft magnetism metal powders, a soft magnetism metal formed body, and a method of producing soft magnetism. "Soft magnetism" means a property of having a higher magnetic permeability and a reduced residual magnetism by deleting an external magnetic field.

BACKGROUND OF THE INVENTION

Recently, remarkable advancements have been made in industrial devices or the like requiring soft magnetic materials having higher than usual magnetic permeability. In addition, soft magnetism metal materials are also required to have a higher specific resistance. In order to comply with these requirements, various studies have been carried out in order to provide a variety of soft magnetism metal powders.

For example, prior art references 1 (National technical report, Vol. 40, No. 1, February 1994) and 2 (Japanese Patent Laid-open Patent No. Hei.5 (1993AD)-326289) disclose a technique for providing a soft magnetism material (i.e. a soft magnetism material formed body) with less iron loss, by sintering, at high temperature and under high pressure conditions, soft magnetism metal particles whose surfaces are coated with an oxide. In addition, prior art reference 3 (Japanese Patent Laid-open Patent No. Hei. 5 (1993AD)-47541) discloses a technique for providing a soft magnetism material with less iron loss by sintering, at high temperature and under high pressure conditions, soft magnetism metal particles whose surfaces are coated by mechano-fusion with a soft magnetism material of higher resistive value. However, the above-mentioned soft magnetism metal materials or powders are not always satisfactory when they are put into practical use. Thus, a need exists to provide a soft magnetism metal powder and/or a soft magnetism material formed body which have a much higher magnetic permeability.

In view of the discussion above, the object of the present invention is to provide a soft magnetism metal powder, a method of treating soft magnetism metal, a soft magnetism metal formed body, and a method of producing soft magnetism.

SUMMARY OF THE INVENTION

The present inventors have found that a body formed from soft magnetism metal particles has higher magnetic permeability when each of the soft magnetism metal particles, when cross-sectioned, has no more than ten crystal particles. In addition, we have found that the number of crystal particles in each soft magnetism metal particle can be reduced by continually heating the soft magnetism metal particles at a temperature of 750–1350° C.

That is, the soft magnetism metal powder of the present invention comprises a majority of particles, each of which has no greater than ten crystal particles on average. This results in a heightened or increased magnetic permeability of the soft magnetism metal powder. By majority, we mean at least 50% of the particles.

The method of treating a soft magnetism metal powder according to the present invention comprises the steps of preparing particles of the soft magnetism metal powder, and heating the particles up to a high temperature in a high temperature atmosphere so that the number of crystal particles in each of the soft magnetism metal powder particles is reduced compared to the number of crystal particles before the heating. This results in a heightened or increased magnetic permeability of the soft magnetism metal powder.

In addition, due to the fact that each of the soft magnetism metal particles has a larger volume than a mass of identical weight and material (i.e., has a relatively low density), heat transfer into each of the particles is rapid, thereby shortening the heating time, i.e., the time required for the crystal particle number reduction process.

The soft magnetism metal formed according to the method of the present invention comprises a majority of soft magnetism metal particles which are coupled together with each other, where each particle of the soft magnetism metal powder has no greater than ten crystal particles on average. The resulting soft magnetism metal powder has heightened or increased magnetic permeability.

The method of producing a soft magnetism formed product according to the present invention comprises the steps of:

preparing a mixture of soft magnetism metal powder; and pressing, or pressing at a higher temperature the mixture of soft magnetism metal powder, thereby heightening or increasing the magnetic permeability of the soft magnetism metal powder. The soft magnetism metal powder, as described above, has no more than 10 crystal particles in each particle of the soft magnetism metal powder. As will be described below, the soft magnetism metal powder may be coated with a resistance material on its outer surface, such that the resistive material has a higher resistance than the bulk, or parent phase of the particle. The soft magnetism metal powder may also be an alloy of iron, the main component, with an alloying metal which is more readily oxidized than iron, prepared by selectively oxidizing the alloying metal. Such a powder may also have a phosphate acid family conversion treated coating, prepared by applying a treating liquid containing phosphoric acid, or be coated by mechano-fusion. In addition, during the crystal particle number reduction process in which the particles are heated to a high temperature, the number of the crystal particles is reduced (i.e., reducing the hardness of each soft magnetism metal particle), thereby providing a soft magnetism metal formed product having higher density than a soft magnetism metal formed product prepared by press-formation of the soft magnetism metal powder.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings.

DETAILED DESCRIPTION OF THE PRESENT INVENTION

Figure 1:
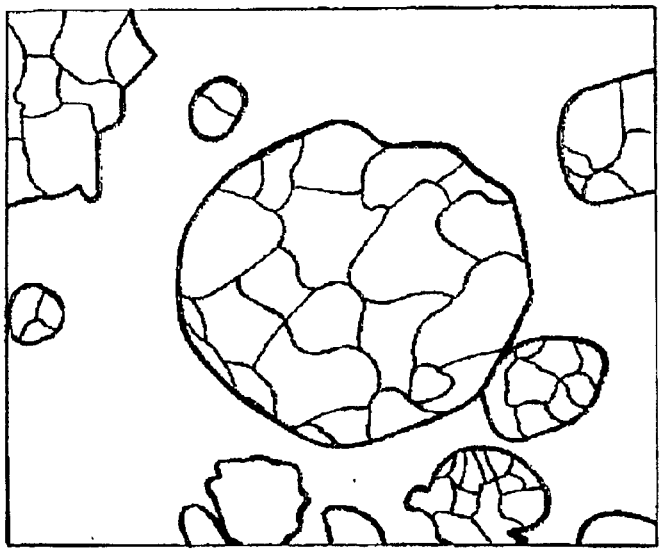
FIG. 1 is a photomicrograph of a soft magnetism metal powder according to the first example prior to the crystal particle number reduction process.

Iron family metals, whether pure iron family metals or iron family metals including alloying elements, are available as raw materials for soft magnetism metal powders. That is, the iron family metal may comprise one or more of Ni, Si, Al, P, and other elements which are generally used as components of soft magnetism materials. Low levels of C, O, and other elements which lower the magnetic permeability are desirable. Thus, raw materials for the soft magnetism metal powder may include, for example, pure iron, iron-aluminum family alloys, iron-silicon family alloys, and iron-nickel family alloys. The percent of C may be less than or equal to 0.1%, in particular less than or equal to 0.01%. The percent of 0 may be less than or equal to 0.5%, in particular less than or equal to 0.1%. The metal powder may be produced by either a water atomizing method or a gas atomizing method. If required, the metal powder may also be produced by a mechanical crushing.

If the particle size of the powder is extremely small, it is difficult to obtain satisfactory magnetic characteristics. If the particle size of the powder is extremely large, the compressibility of the powder is lowered when the soft magnetism formed body is formed by compression. Thus, preferably, the particle size of the powder particles may range from 10 to 300 $\mu$m, particularly 50–300 $\mu$m, more preferably 50–150 $\mu$m, most preferably 10–100 $\mu$m. Rather than having particles of the metal powder which all have the same size, preferably, the metal powder comprises a mixture of small and large particle sizes in order to increase the density of the soft magnetism metal formed body.

In a cross-section of the soft magnetism metal formed body, each of the particles thereof should have no more than ten crystal particles on average. If the number of the crystal particles in the cross-section of the particle is greater than ten, the magnetic permeability of the soft magnetism metal formed body is unsatisfactory. It is desirable to reduce the number of the crystal particles in the cross-section of the particle in order to increase the magnetic permeability. However, the required heating time increases, which is expensive. Thus, in order to balance the desired magnetic permeability properties and reduce the production cost and other factors, the number of the crystal particles in the cross-section of the particle should not be not greater than 8, preferably no greater than 6, more preferably no greater than 5, even more preferably no greater than 4, most preferably no greater than 3. For example, the cross-section may contain 1 to 6 crystal particles, 1 to 5 crystal particles, or 1 to 4 crystal particles.

In addition, the crystal particles in each of the metal powder particles may be defined as larger than one fifth of the grain size based on JIS G0552 (Methods of Ferrite Grain Determining Test for Shell).

The following method can be employed to produce a soft magnetism metal powder which comprises a majority of particles, each of which when cross-sectioned has no more than ten crystal particles on average. In the first step, a crystal particle number reduction process is performed by heating the metal particles at a high temperature in a high temperature atmosphere in order to reduce the number of the crystal particles in the metal particles. The temperature of the crystal particle number reduction process is higher than that of any pre-crystal particle number reduction process. It is possible to reduce the number of the crystal particles by half or more compared to the number of crystal particles before heating. For example, the number of the crystal particles may be ⅓ or less, ¼ or less, or ⅕ or less compare to the number of crystal particles before heating. In general, reducing the number of crystal particles causes the size of the remaining crystal particles to increase.

If the metal particles are not oxidized, it is desirable to employ a non-oxygen atmosphere for heating the metal particles. If it is desired that a portion of the metal particles oxidize, an atmosphere may be provided which does not oxidize iron, but which causes the alloying elements in the particle to oxidize. Examples of these atmospheres are a reducing atmosphere (such as a hydrogen gas atmosphere or a hydrogen-containing atmosphere), a vacuum atmosphere, and an argon atmosphere. The advantage of the reducing atmosphere, is that it retains the magnetic permeability inherent in the metal (generally iron). If the soft magnetism metal powder is formed from an alloy which includes iron as main component, and an amount (e.g., less than 3.5 weight percent) of an alloying element which is more readily oxidized than iron, the atmosphere for heating the metal particles may be an atmosphere which is reducing relative to iron and oxidizing relative to the alloying element. Such an atmosphere may comprise, for example, water vapor and hydrogen as a reducing gas.

Although the crystal particle number may be reduced by increasing the heating temperature, thereby providing a higher magnetic permeability, the heat energy consumed increases, resulting in increased costs. The heating temperature required in the crystal particle number reduction process may be determined by considering various factors such as the properties of the raw materials of the metal particles, the required magnetic permeability, and the production cost. In general the heating temperature ranges from 750 through 1350° C. Thus, depending on which of the above factors is most important, the upper limit of the heating temperature may be, for example, 1320, 1300, 1280, 1250, or 1220° C., while the lower limit of the heating temperature may be, for example, 780, 800, 820, 840, 880, 900, or 950° C. Thus, after balancing the reduction of the crystal particle number and the production cost, the desirable heating temperature ranges may be, for example, 800–1320° C., 820–1280° C. 850–1220° C., and 900–1100° C., but are not restricted to these ranges.

The duration of the heating time may vary depending on the required magnetic permeability and the heating temperature. In general, it is possible to employ heating times of 20 minutes to 2 hours, or 30 minutes to 90 minutes. The heating time is preferably not less than 10 (ten) minutes. In addition, due to the fact that each of the soft magnetism metal particles has a volume which is larger than a mass which is identical therewith in weight and material (i.e., a relatively low volume), heat transfer into each of the particles is rapid, thereby shortening the heating time, i.e., the required time for the crystal particle number reduction process. The heating method is not particularly restricted, and thus heat transfer or heat radiation in heating furnace, or induction heating may be used.

It is desirable that the outer surface of each particle is covered with a resistive material which has a higher resistivity than the parent phase of the particle. By parent phase, we mean the bulk phase of the particle, prior to coating with a resistive material. As a result, the eddy current is reduced. In particular, when a soft magnetism metal powder formed body is produced by coupling a majority of the metal particles with each other, the connection between the metal phases is restricted, resulting in a soft magnetism metal powder formed body with low resistivity. Thus, it is advantageous to reduce the eddy current.

The metal particle having a soft magnetism property preferably has an alloying element which is more readily oxidized than the iron when iron is the main component. This causes an oxide to form, thereby generating a resistive material having higher resistivity. The resistive material having higher resistivity can be in the form of an oxide which is generated when the alloying element is selectively oxidized on the outer surface of the metal particle, when the soft magnetism metal particles are heated. In this case, the alloying element contained in the metal particle is limited to less than 3.5 weight percent, so that the particle is iron rich, making it possible to maintain the excellent magnetic permeability and magnetic flux density inherent in iron, and which makes it possible to easily form the high resistive material by selective oxidization.

In the above case, if the amount of the alloying element having stronger oxidizing properties than iron is extremely small, it becomes difficult to form a material from the oxide having higher resistivity. Thus, the lower limit of the content of the alloying element may be, for example, 0.3 percent or 0.5 percent. The alloying element oxidizing more readily than iron may be at least one of Al, Si, Mg, and Ca. The amount of the alloying element is preferably, less than 3.5 weight percent more preferably less than 2.5 weight percent. Examples of an oxide having higher resistivity than the parent phase of the metal particle are aluminum oxide, silicon oxide, magnesium oxide, and calcium oxide.

In addition to oxidization, the mechanical energy provided by mechanical-fusion may be used to coat the above-mentioned higher resistive material on the outer surface of the metal particle. Mechano-fusion is a method of adhering one substance to another substance by means of mechanical energy provided by the collisions produced by kneading a mixture of the substances.

Phosphoric acid family conversion treated films may be used to provide the higher resistivity material, which has the advantage of a reduced eddy current. The phosphoric acid family conversion treated film can be coated on the surface of the metal particle itself, or together with the oxide which has high resistivity. In the latter case, the phosphoric acid family conversion treated film is coated on a first higher resistivity material obtained by selective oxidizing or mechano-fusion. The phosphoric acid family conversion treated film can act as a second higher resistivity material. In such a process, the first higher resistivity material obtained by selective oxidation or mechano-fusion may be prevented from peeled off of the parent phase of the particle.

The above-mentioned phosphoric acid family conversion treated film may be prepared by means of a treating liquid containing phosphoric acid, applying this treating liquid onto the first higher resistivity film, and drying the resulting liquid, in this order. This method easily forms the phosphoric acid family conversion treated film on the outer surface of the first higher resistive material. The treating liquid can also contain an amount of boric acid and/or an amount of magnesia. In the above-mentioned case, the following methods (a) and (b) may be used.

(a) The first higher resistivity material may be obtained as follows: a soft magnetism alloy powder which contains iron as its main element and an amount (e.g., 3.5 weight %) of alloying element which is more readily oxidized than iron is prepared. Then, the soft magnetism alloy powder is heat treated in a reducing atmosphere equivalent to the crystal particle number reduction process, such that the atmosphere is reducing and oxidizing, respectively, relative to the iron and the alloying element, in order to reduce the number of the crystal particles in the alloying powder by enlarging the crystal particles, and in addition, forming a first higher resistivity material which has higher resistivity than the iron on the outer surface of the particle, and which is in the form of an oxide obtained by selectively oxidizing the alloying element. Then, a treating liquid containing phosphoric acid is prepared, and applied to the first higher resistivity film. The resulting liquid is dried, thereby providing on the surface of the first higher resistivity material on the alloy particle, a second higher resistivity material phosphoric acid family conversion treated film, and thereby forming a soft magnetism metal powder. This method makes it possible to produce the soft magnetism metal powder easily and with high reliability.

(b) This method is a second process for providing a soft magnetism metal powder. In this method, a soft magnetism metal powder is mixed with a higher resistivity material. Mechanical energy is applied by mechano-fusion to the mixture, thereby forming a first higher resistivity material on the surface of the metal particle. Then, a treating liquid containing phosphoric acid is prepared, and applied to the first higher resistivity film. The resulting liquid is dried, providing, on the surface of the first higher resistivity material, a second higher resistivity material phosphoric acid family conversion treated film, thereby forming a soft magnetism metal powder. In this method the coating of the first higher resistivity material is provided by mechanical energy resulting from mechano-fusion. The advantage of this process is that there is greater flexibility in combining the metal particle and the first higher resistive material. Examples of the material to be coated on the surface of the metal particle are Mn—Zn Ferrite ($Mn_{0.6}$ $Zn_{0.3}$ $Fe_{2.1}$ $O_4$) and $SiO_2$.

As discussed above, soft magnetism metal powder formed body may be produced using a soft magnetism metal powder whose particles have a reduced number of crystal particles. That is to say, a soft magnetism metal powder formed body may be provided wherein the soft magnetism metal particles are connected to each other by way of the phosphoric acid films of the coating. In this soft magnetism metal powder formed body, the coating provided by the phosphoric acid films, which act as higher resistivity materials, makes it possible to maintain the thickness of the formed body, resulting in higher values of resistivity, thereby reducing eddy currents.

The soft magnetism metal powder formed body is prepared by connecting the soft magnetism metal particles, for example by means of pressing or pressing while heating (i.e., hot pressing). That is, by pressing or hot pressing a mixture of soft magnetism metal particles, the crystal particle number of each of the metal particles is reduced, and the soft magnetism metal powder formed body is formed in such a manner that the soft magnetism metal particles are connected to each other. The soft magnetism metal powder formed body can be formed such that the soft magnetism metal particles are connected to each other by means of the adjacent phosphoric acid films, while each of the phosphoric acid films is maintained as a coating.

The above-mentioned hot pressing of mixtures of the soft magnetism metal particles at a predetermined temperature integrally combines the metal particles. This method provides a soft magnetism metal particle formed body easily and reliably. The preferred temperature ranges of the hot pressing are from 150 to 600° C., more preferably from 450 to 600° C. If the temperature is too low, the deformation resistance of the metal particle is too large, resulting in a difficulty in obtaining a dense soft magnetism metal particle formed body. On the other hand, if the temperature is too high, the quality of the phosphoric acid family conversion treated film changes. The applied pressure may be, for example, 2.0–10 tonf/cm$^2$, particularly 4.5–7 tonf/cm$^2$, but is not limited thereto. The atmosphere for hot pressing may be an argon gas atmosphere or an air atmosphere. The resulting soft magnetism metal particle formed body may also be annealed if desired, at a temperature of about 400 to 600° C.

In addition, when the soft magnetism metal particles are subjected to the crystal particle number reduction process, the grain size of the crystal particle in the metal particle increases, resulting in increased hardness of the metal particle. This makes it possible to easily compress the particles in the hot compression process, thereby increasing the density of the soft magnetism metal particle formed body. In this manner the magnetic permeability and mechanical strength of the soft magnetism metal particle formed body are increased.

Having generally described this invention, a further understanding can be obtained by reference to certain specific examples which are provided herein for purposes of illustration only, and are not intended to be limiting unless otherwise specified.

EXAMPLES

Example 1

(1) An mixture of soft magnetism metal particles is prepared which has the following soft magnetism property.

Composition: Fe, 0.004%C, 0.25%O, 0.01%Si, 0.01%Mn, 0.001% P (% by weight)

Production Method: Gas Atomizing Method

Particle Size: 50–150 $\mu$m

The above wide range of particle sizes ranging from 50 to 150 $\mu$m is employed in order to provide a higher density of the soft magnetism metal formed body. A metal powder having a mixture of smaller particles and larger particles is preferred to particles which are all of one size.

Next, the resulting mixture of soft magnetism metal particles is thermally treated in a crystal particle number reduction process in which the soft magnetism metal particles are held in a reducing atmosphere (pure hydrogen atmosphere) and heated for an hour at a temperature of 1000° C. Thereafter, the mixture of soft magnetism metal particles is cooled down to a predetermined temperature. The above crystal particle number reduction process enlarges the crystal particles in each of the soft magnetism metal particles, resulting in a soft magnetism metal powder in which the majority of particles, when cross-sectioned, have no greater than ten crystal particles (more preferably, no greater than five). The particle size in the soft magnetism metal particles is found to be about 100 $\mu$m after inspection.

(2) 100 g of the soft magnetism metal powder particles, after the crystal particle number reduction process is carried out, is mixed with 5 ml of a phosphoric acid family conversion treatment liquid (principal components: phosphoric acid, boric acid, and magnesia).

The phosphoric acid family conversion treatment liquid contains, per 1 litter of water, 163 g of phosphoric acid, 30 g of boric acid, and 30 g of magnesia, by weight. The phosphoric acid family conversion treatment liquid is dried at a temperature of 200° C. for 20 minutes. Thereafter, the resulting phosphoric acid family conversion treatment medium is crushed, resulting in a crushed metal particle coated with a phosphoric acid family conversion treated film.

(3) 50 g of a mixture of the metal particles coated with the phosphoric acid family conversion treated film is filled into the pressing cavity of a compression device which is heated to a constant temperature of 450° C. In this device, the mixture of the metal particles coated with the phosphoric acid family conversion treated film is pressed under a pressure of 7 tonf/cm$^2$ at a temperature of 450° C., to provide a higher density, column-shaped soft magnetism metal particle formed body with an outer diameter of 30 mm. The density of the soft magnetism metal particle formed body is found to be 7.55 gf/cm$^3$. An electronic balance is used to determine the weight of the soft magnetism metal particle formed body, a micrometer is used to determine the dimensions thereof for determining the volume, and the density of the soft magnetism metal particle formed body is calculated by the formula:

$$\text{density}=(\text{weight}/\text{volume}).$$

(4) The magnetic flux density of the soft magnetism metal particle formed body is calculated as follows. A metal wire of the soft magnetism metal particle formed body is cut into a column shaped sample having a diameter of 10 mm and a length 10 mm. The resulting sample is held in an electromagnet in a DC magnetizing property recording device made by RIKEN DENSHI (product code BHU-60) and is subjected to an electromagnetic field of H=625 Oe (oersted). A magnetic flux density $B_{625}$=1.92T T (Tesla) was observed. Due to the fact that 1 Oe is about 79 A·m$^{-1}$, 625 Oe is equivalent to 49375 A·m$^{-1}$ in SI units. Conventional metal particle formed bodies which have not been subjected to the crystal particle reduction process, have maximum magnetic permeabilities as low as 200 $\mu$m. In addition, the number of crystal particles in a cross-section of a single metal particle according to the present invention, is less than ten, in particular less than 5.

In the present example, the crystal particle number reduction process was performed such that the metal particles were heated in a reducing atmosphere, which has the advantage of removing oxide components of the metal particles, thereby ensuring the inherent magnetic permeability of iron.

(5) The volume iron loss of the soft magnetism metal particle formed-body was measured as follows. The above-produced soft magnetism metal particle formed-body was cut to produce a ring-shaped member having an inner diameter of 11 mm, an outer diameter of 15 mm, and a thickness of 2 mm (or alternatively, an inner diameter of 19 mm, an outer diameter of 26 mm, and a thickness of 2 mm). The resulting ring-shaped member is provided on its primary and secondary sides with a pair of 50 turn coil windings. The resulting device is tested with an AC magnetizing property device provided by IWASAKI TSUSHIN (product code, B-Hanalyzer SY-8232) and subjected to an AC current of 10 kHz. The resulting iron core was found to be 105 $kW/M^3$ at 50 mT.

(6) The resistivity of the soft magnetism metal particle formed body was measured as follows. The above-produced soft magnetism metal particle formed body was cut with a micro-cutter to produce a rectangular solid having dimensions of 2 mm×3 mm×12 mm. The outer surface of the rectangular solid was buffed to a mirror finish, and provided a resistivity of as high as 10000 $\mu\Omega\cdot$cm when measured by a four terminal method.

Example 2

The second example of the present invention is produced similarly to the first example. The following description is focused on the differences between the first example and the second example. The second example of the soft magnetism metal powder has a composition of Fe, 0.004%C, 0.03%O, 3.0%Si, 0.01%Mn, 0.01%P (weight %). That is to say, the soft magnetism metal powder contains less than about 3.5% Si as an alloying element which is more readily oxidized than iron, in addition to the main component of iron which has a soft magnetism property.

In the production process of the second example, the atmosphere for heating the metal particles is a nitrogen gas atmosphere which contains 3% hydrogen gas by volume ratio such that $H_2/H_2O=10$. Thus, this atmosphere does not oxidize iron, but does oxidize the Si, resulting in Si oxide associated with the metal particles. The Si oxide is a higher resistivity material than the iron.

Next, a crystal particle number reduction process is carried out by subjecting the soft magnetism metal particles to a temperature of 1000° C. for an hour. This increases the grain size of the crystal particles of the soft magnetism metal particle, which causes the metal particle to have, when cross-sectioned, no greater than ten (in particular, no greater than five) crystal particles on average, and which produces an oxide of the alloying element. As previously mentioned, due to the fact that the oxide of the alloying element has a higher resistivity than iron, the oxide of the alloying element can act as a higher resistivity material which reduces eddy current loss.

In addition, the soft magnetism metal powder particles, after being subjected to the crystal particle number reduction process, are mixed with a phosphoric acid family conversion treatment liquid (principal components: phosphoric acid, boric acid, and magnesia). The soft magnetism metal powder (particles) were removed from the phosphoric acid family conversion treatment liquid and dried. Thereafter, the soft magnetism metal powder particles were crushed, resulting in crushed metal particles coated with a phosphoric acid family conversion treated film. This film covering the oxide of the alloying element provides the advantage of preventing the peeling of the oxide coating.

A mixture of the metal particles coated with the phosphoric acid family conversion treated film was filled into the pressing cavity of a compression device which was heated up to a constant temperature. In this device, the mixture of the metal particles coated with the phosphoric acid family conversion treated film were pressed under a pressure of 7 $tonf/cm^2$ at the temperature required to provide a higher density column-shaped soft magnetism metal particle formed body. Similarly to the first example, the second example of the soft magnetism metal particle formed body was found to have a remarkably improved magnetic permeability.

Example 3

The third example of the present invention is produced in a manner similar to that of the second example. The following description is focused on differences between the third example and the second example. The third example of the soft magnetism metal powder has a composition of Fe, 0.004%C, 0.03%O, 3.0%Al, 0.01%Mn, 0.01%P (by weight). Thus, the soft magnetism metal powder contains less than about 3.5% Al as an alloying element which is more readily oxidized than iron. Then, the crystal particle number reduction process is carried out to increase the grain size of the crystal particles of the soft magnetism metal particle, so that when a metal particle is cross-sectioned, it has no greater than ten (particularly, no greater than five) crystal particles on average, and has an oxide of the alloying element. Moreover, similarly to the second example, a mixture of the metal particles coated with the phosphoric acid family conversion treated film were filled into the pressing cavity of a compression device which was heated up to a constant temperature. With this device, the mixture of the metal particles coated with the phosphoric acid family conversion treated film was pressed under a pressure and temperature sufficient to provide a higher density column-shaped soft magnetism metal particle formed body. Similarly to the first example, the third example of the soft magnetism metal particle formed body was found to have remarkably improved magnetic permeability.

TEST EXAMPLES

Test Example 1

Figure 2:
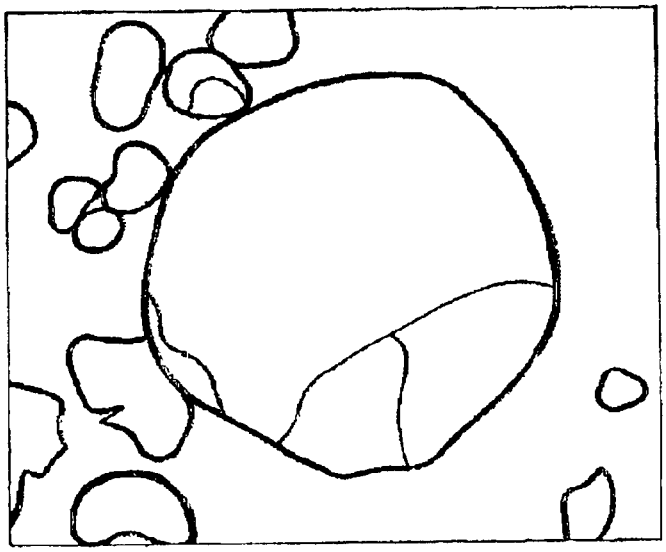
FIG. 2 is a photomicrograph of a soft magnetism metal powder according to the first example after the crystal particle number reduction process.

Test example 1 was produced basically similarly to the first example. FIG. 1 is a pictorial illustration (magnification: ×200, natal etch) of a photomicrograph of a soft magnetism metal powder according to a first test example which is produced by a gas atomizing method prior to the crystal particle number reduction process. FIG. 2 is a pictorial illustration of a photomicrograph (magnification: ×200, natal etch) of the soft magnetism metal powder according to the first test example after the crystal particle number reduction process (pure hydrogen gas atmosphere, temperature: 1000° C., time duration: 60 minutes). As can be easily understood from comparing FIG. 1 with FIG. 2, before the crystal particle number reduction process is performed, the number of the crystal particles found in a cross-section of each of the soft magnetism metal particles is in excess of ten. In contrast, after the crystal particle number reduction process is performed, the number of the crystal particles found in the cross-section of each of the soft magnetism metal particles is much lower. In summary, the number of the crystal particles found in the cross-section of each of the soft magnetism metal particles is reduced to ⅓ to ⅕.

Figure 4:
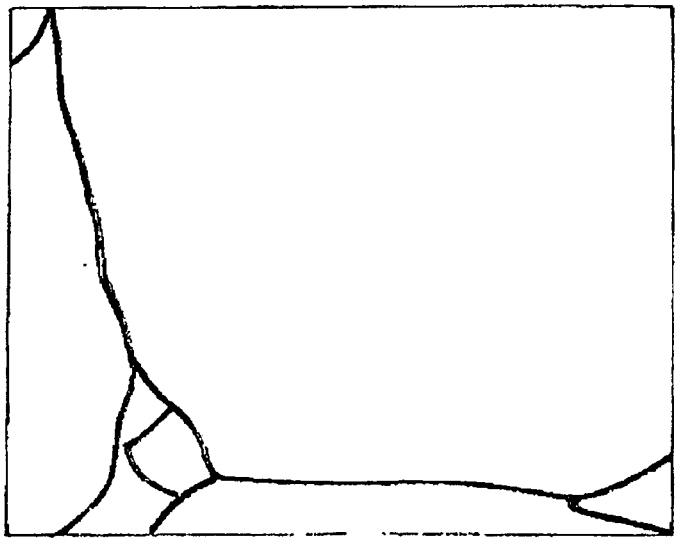
FIG. 4 is a photomicrograph of a body formed of a soft magnetism metal powder according to the first example after the crystal particle number reduction process.

The above soft magnetism metal particles are subjected to a phosphoric acid conversion treatment in order to be coated with phosphoric acid family conversion treated films. The resulting soft magnetism metal particles were pressed at a temperature similar to that of the first example, thereby producing a highly dense soft magnetism metal particle formed body. FIG. 4 is a pictorial illustration (magnification: ×400, natal etch) of a photomicrograph of the highly dense soft magnetism metal particle formed body. As shown in FIG. 4, the number of the crystal particles found in the cross-section of each of the soft magnetism metal particles is 1, 2, and 3. That is, on average, the number of crystal particles found in the cross-section of each of the soft magnetism metal particles is relatively low (i.e., not greater than 3).

Comparative Example 1

Figure 3:
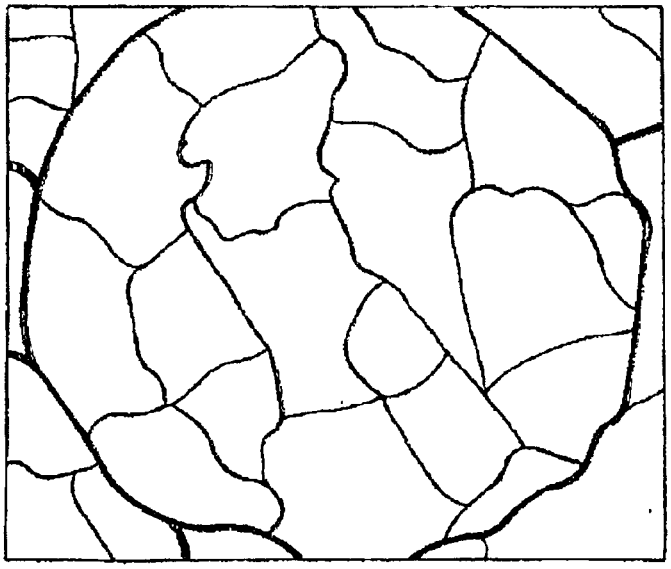
FIG. 3 is a photomicrograph of a body formed of a soft magnetism metal powder according to the first example, prior to the crystal particle number reduction process.

The first comparative example is produced in a manner similar to the first test example except that for the first comparative example, the crystal particle number reduction process is omitted. The above soft magnetism metal particles of the first comparative example are put into a phosphoric acid conversion treatment so as to be coated with phosphoric acid family conversion treated films, and the resulting soft magnetism metal particles are made pressed at a temperature similar to that of the first example, thereby producing a highly dense soft magnetism metal particle formed body. FIG. 3 is a pictorial illustration (magnification: ×400, natal etch) of the photomicrograph of the highly dense, soft magnetism metal particle formed body. As shown in FIG. 3, the number of the crystal particles found in the cross-section of each of the soft magnetism metal particles is approximately fifty.

Test Example 2

Figure 5:
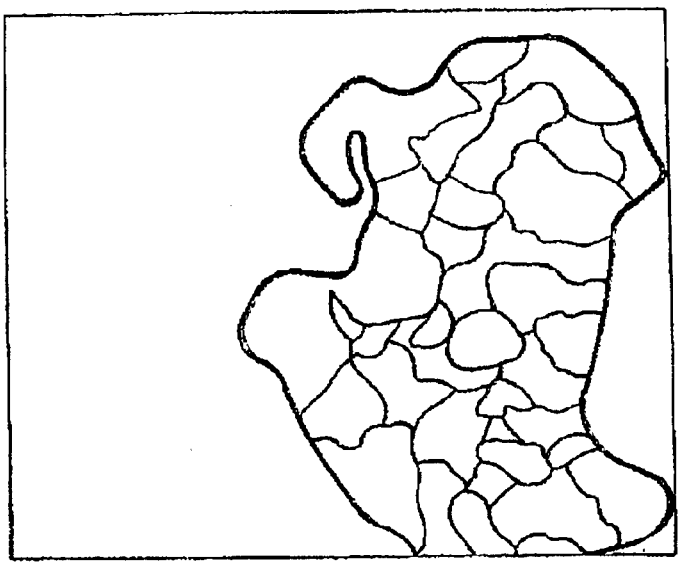
FIG. 5 is a photomicrograph of a soft magnetism metal powder according to the second example, prior to the crystal particle number reduction process.
Figure 6:
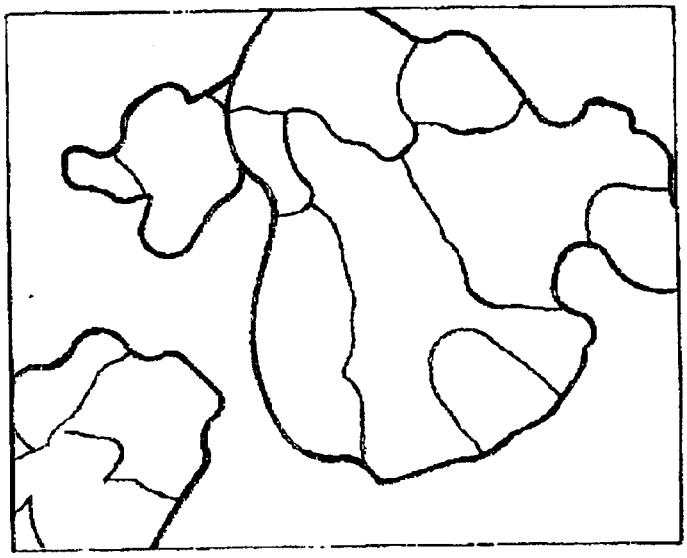
FIG. 6 is a photomicrograph of a soft magnetism metal powder according to the second example after the crystal particle number reduction process.

A second test example was produced similar to the first example. FIG. 5 is a pictorial illustration of a photomicrograph (magnification: ×200, natal etch), of a soft magnetism metal powder according to the second test example, which is produced by a water atomizing method, prior to the crystal particle number reduction process. FIG. 6 is a pictorial illustration of a photomicrograph (magnification: ×200, natal etch) of the soft magnetism metal powder according to the second test example after the crystal particle number reduction process. The soft magnetism metal powder according to the second test example has a composition, by weight, of Fe, 0.001%C, 0.1%O, 0.02%Si, 0.18%Mn, 0.014%P, 0.013%S. The crystal particle number reduction process is performed in a manner similar to that of the first example. As can be easily understood from comparing FIG. 5 with FIG. 6, before the crystal particle number reduction process is performed, the number of the crystal particles found in a cross-section of each of the soft magnetism metal particles is about fifty on average. In contrast, after the crystal particle number reduction process is performed, the number of the crystal particles found in the cross-section of each of the soft magnetism metal particles, is no greater than ten on average. That is, the number of the crystal particles found in the cross-section of each of the soft magnetism metal particles is reduced to about ⅕.

Figure 7:
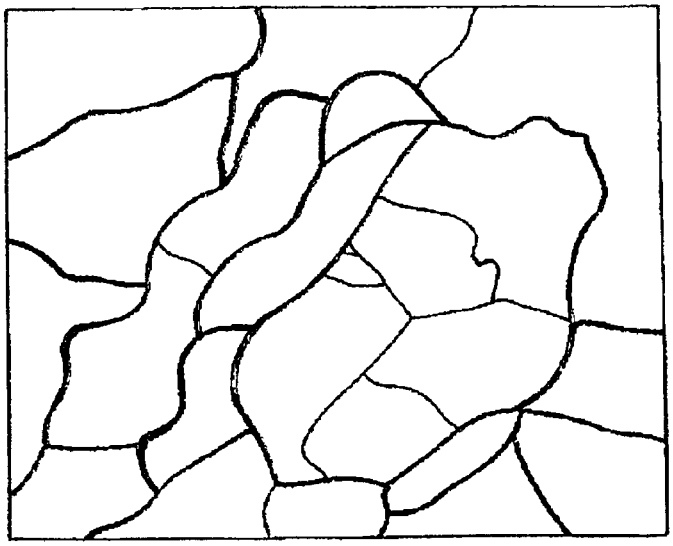
FIG. 7 is a photomicrograph of a body formed of a soft magnetism metal powder according to the second example, after the crystal particle number reduction process.

The above soft magnetism metal particles were put into a phosphoric acid conversion treatment in order to coat them with phosphoric acid family conversion treated films. The resulting soft magnetism metal particles were pressed at a temperature similar to that of the first example, thereby producing a highly dense soft magnetism metal particle formed-body. FIG. 7 is a pictorial illustration of a photomicrograph (magnification: ×200, natal etch) of the highly dense soft magnetism metal particle formed-body. As shown in FIG. 7, the number of the crystal particles found in the cross-section of each of the soft magnetism metal particles is not greater than 10 on average.

Figure 8:
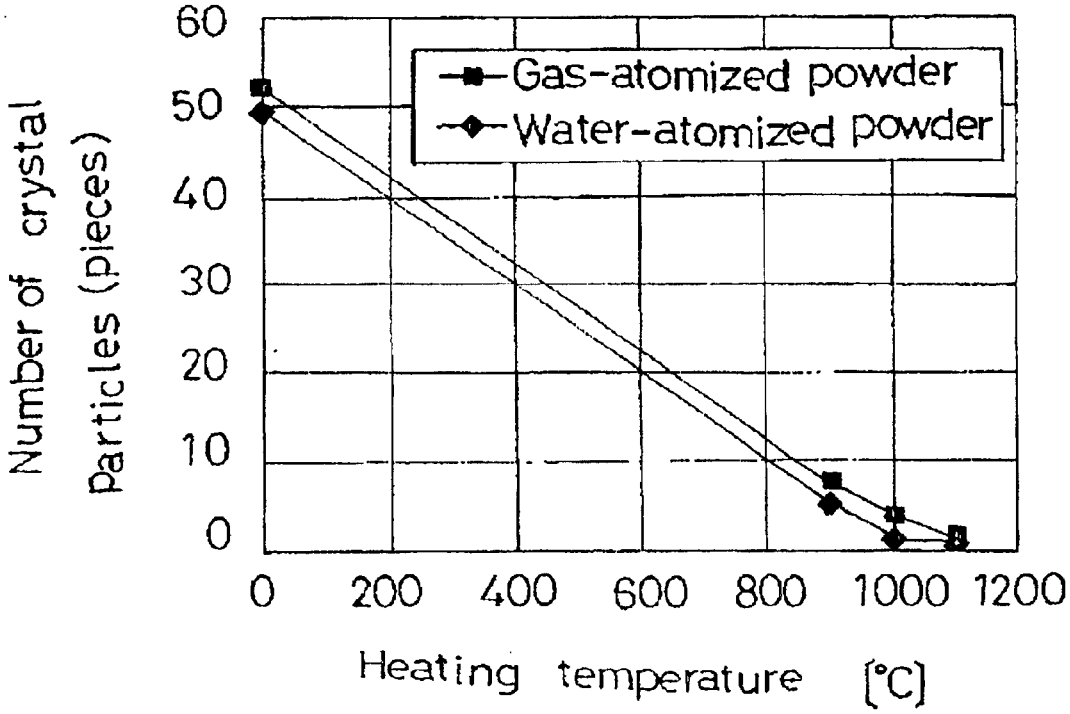
FIG. 8 is a graph of the relationship between the number of crystal particles in each of the soft magnetism metal particles and the heating temperature in the crystal number reduction process.

The inventors have found a relationship between the number of the crystal particles found in the cross-section of each of the soft magnetism metal particles, and the heating temperature in crystal particle number reduction process as shown in FIG. 8. In FIG. 8, the vertical and horizontal axes indicate, respectively, the number of the crystal particles, on average, found in the cross-section of each of the soft magnetism metal particles, and the heating temperature (° C.) of crystal particle number reduction process. As can be understood from FIG. 8, when the heating temperature increases, the number of the crystal particles observed decreases. In order to provide for a number of crystal particles found in the cross-section of each of the soft magnetism metal particles of no greater than ten, the heating temperature is preferable no greater than 800° C., particularly no greater than 850° C.

Figure 9:
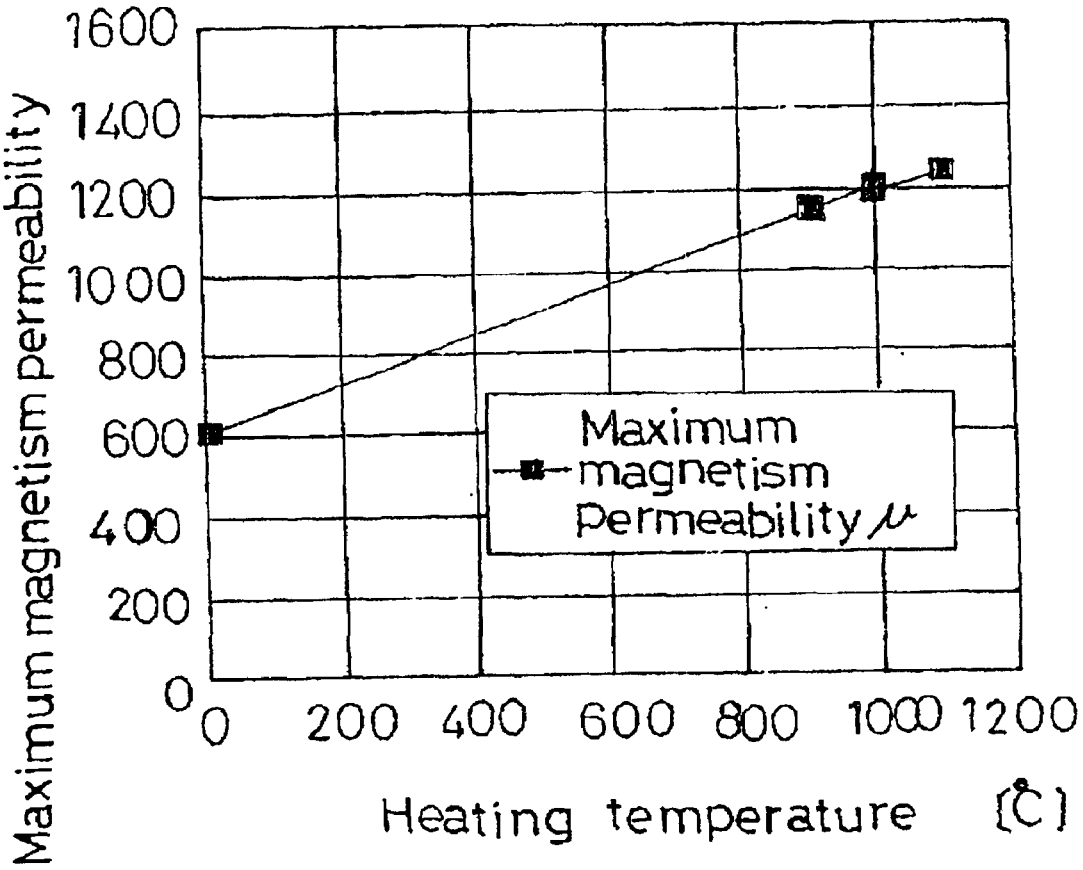
FIG. 9 is a graph of the relationship between the magnetic permeability of a soft magnetism metal body formed by pressing and heating the soft magnetism metal particles and the heating temperature in the crystal number reduction process.

The inventors have also found a relationship between the magnetic permeability of the soft magnetism metal particle formed-body and the heating temperature in the crystal particle number reduction process, as shown in FIG. 9. In FIG. 9, the vertical and horizontal axes, respectively, indicate the magnetic permeability of the soft magnetism metal particle formed-body and the heating temperature (° C.) in crystal particle number reduction process. As shown in FIG. 9, as the heating temperature (° C.) of the crystal particle number reduction process increases, the magnetic permeability of the soft magnetism metal particle formed-body increases. This is probably due to the relevant number of crystal particles in each of the metal particles which resulted from the enlargement of each of the crystal particles.

Advantages of the Present Invention

The soft magnetism metal powder of the present invention provides improved magnetic permeability by heating the soft magnetism metal powder of the present invention, thereby providing a reduced number of crystal particles in each particle of the soft magnetism metal powder. In addition, an improved soft magnetism metal particle formed body may be prepared having improved magnetic permeability.

The invention has thus been shown and described with reference to the specific embodiments above. However, it should be understood that the present invention is in no way limited to the details of the illustrated structures, but changes and modifications may be made without departing from the scope of the appended claims.

What is claimed is:

1. A soft magnetism metal powder comprising a majority of particles each of which has at least one and no greater than ten crystal particles on average in its cross-section.

2. The soft magnetism metal powder of claim 1, wherein each particle comprises a parent phase and a resistive material on an outer surface of the particle, and the resistive material has a higher resistivity than the parent phase.

3. The soft magnetism metal powder of claim 2, wherein the soft magnetism metal particle is an alloy comprising iron as a main component and less than 3.5 weight % of an alloying element, wherein the alloying element is more easily oxidized than iron, the higher resistive material is in the form of an oxide, and the oxide is prepared by selectively oxidizing the alloying element by heating the particles.

4. The soft magnetism metal powder of claim 2, wherein the resistive material is a phosphate acid family conversion treated coating.

5. The soft magnetism metal powder of claim 2, wherein the resistive material is coated on the outer surface of each of the soft magnetism particles.

6. The soft magnetism metal powder of claim 5, wherein the coating of the resistive material on the soft magnetism metal particle is prepared by mechano-fusion.

7. The soft magnetism metal powder of claim 4, wherein the phosphate acid family conversion treated coating is prepared by applying a treating liquid comprising a phosphoric acid on the outer surface of the soft magnetism metal particle and drying the treating liquid.

8. The soft magnetism metal powder as set forth in claim 1, wherein an outer surface of the soft magnetism metal particle is coated with a conversion treated coating.

9. The soft magnetism metal powder of claim 1, prepared by heating the soft magnetism metal particles to a high temperature in a high temperature atmosphere, thereby reducing the number of crystal particles in each of the soft magnetism metal particles.

10. The soft magnetism metal powder of claim 4, wherein the crystal particles of the soft magnetism metal particles are connected to each other by the phosphoric acid family conversion treated coating.

11. A soft magnetism metal formed body comprising a majority of the soft magnetism metal particles of claim 1, which are coupled together with each other, and each of which have a cross-section having no greater than ten crystal particles on average.

12. A method of producing a soft magnetism formed body comprising the steps of:

preparing a mixture comprising the soft magnetism metal powder of claim 1, and pressing the mixture of the soft magnetism metal powder.

13. The method of claim 12, wherein the pressing is carried out at a temperature of 150 to 600° C.

14. The method of claim 12, wherein the pressing is carried out at a temperature of 450 to 600° C.

15. The method of claim 12, wherein the pressing is carried out at a pressure of 4.5 to 7 tonf/cm$^2$.

16. The soft magnetism metal powder of claim 3, wherein the amount of alloying element is 0.3 to less than 3.5 weight %.

17. The soft magnetism metal powder of claim 1, wherein the metal comprises an alloy of iron, as a main component, no more than 3.5 wt % of at least one alloying element selected from the group consisting of Al, Mg, Si, and Ca, no more than 0.1 wt % C, and no more than 0.5 wt % O.

18. The soft magnetism metal powder of claim 1, wherein the particle size of the powder is 10 to 300 $\mu$m.

* * * * *